US008797254B2

(12) United States Patent
Uchibe

(10) Patent No.: US 8,797,254 B2
(45) Date of Patent: Aug. 5, 2014

(54) LIQUID CRYSTAL DISPLAY DEVICE

(75) Inventor: Makoto Uchibe, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 243 days.

(21) Appl. No.: 13/391,532

(22) PCT Filed: Aug. 19, 2010

(86) PCT No.: PCT/JP2010/064000
§ 371 (c)(1),
(2), (4) Date: Apr. 20, 2012

(87) PCT Pub. No.: WO2011/021663
PCT Pub. Date: Feb. 24, 2011

(65) Prior Publication Data

US 2012/0200485 A1 Aug. 9, 2012

(30) Foreign Application Priority Data

Aug. 21, 2009 (JP) ..... 2009-192028

(51) Int. Cl.
*G09G 3/36* (2006.01)

(52) U.S. Cl.
USPC ..... 345/102

(58) Field of Classification Search
USPC ..... 345/87, 89, 102, 690; 349/61
See application file for complete search history.

(56) References Cited

U.S. PATENT DOCUMENTS 7,826,681 B2 * 11/2010 Kerofsky et al. ..... 382/274
7,944,429 B2 * 5/2011 Kang et al. ..... 345/102
2003/0038904 A1 * 2/2003 Kaneko et al. ..... 349/110
2004/0155875 A1 * 8/2004 Abe et al. ..... 345/211
2005/0184952 A1 * 8/2005 Konno et al. ..... 345/102
2007/0296688 A1 * 12/2007 Nakamura et al. ..... 345/102
2009/0015539 A1 * 1/2009 Rumreich et al. ..... 345/102

FOREIGN PATENT DOCUMENTS

JP 2000-242255 A 9/2000
JP 2000-276091 A 10/2000
JP 2001-21863 A 1/2001
JP 2002-99250 A 4/2002
JP 2003-58101 A 2/2003
JP 2004-212503 A 7/2004
JP 2005-258403 A 9/2005
JP 2007-189362 A 7/2007

* cited by examiner

*Primary Examiner* — Joe H Cheng
(74) *Attorney, Agent, or Firm* — Birch, Stewart, Kolasch & Birch, LLP

(57) ABSTRACT

A liquid crystal display device includes a local dimming function that reduces the feeling of strangeness given to viewers caused by light leakage. A video display control portion controls the aperture ratio of liquid crystal pixel outside an image display area. A backlight control portion controls the brightness value of light emitting element that illuminate a region outside the image display area so as to be a predetermined value in response to control signals output from the video display control portion. A liquid crystal display device controls the brightness of the region outside the image display area so as to be a predetermined value on the basis of the correlation between the aperture ratio of the liquid crystal pixel outside the image display area and the brightness value of the light emitting element that illuminates the region outside the image display area.

9 Claims, 12 Drawing Sheets

--PRIOR ART--

--PRIOR ART--

--PRIOR ART--

LIQUID CRYSTAL DISPLAY DEVICE

TECHNICAL FIELD

The present invention relates to a liquid crystal display device variably controlling a video display area of a liquid crystal panel and displaying a video inside the video display area.

BACKGROUND ART

With the increasing screen size of the liquid crystal display device, there has been proposed a liquid crystal display device that variably controls a video display area of the liquid crystal panel, in order to achieve power saving and comfortable viewing of the video. When desiring to enjoy a video overflowing with the feeling of being at a live performance, for example, when viewing a sports program or a movie, the viewer causes the video to be displayed on the entire surface of the liquid crystal panel of a large-screen liquid crystal display device. On the other hand, when viewing the other videos, for example, a news commentary program in which a newscaster simply reads a news, the video is displayed as a sub-screen in a restricted video display area of the liquid crystal panel to achieve power saving.

Such a liquid crystal display device uses, as a backlight light source illuminating the liquid crystal panel, a light emitting element such as an LED (Light Emitting Diode) as in an image display device disclosed in Patent Document 1. The image display device disclosed in Patent Document 1 has a so-called local dimming function that, when the video display area of the liquid crystal panel is changed, turns on LEDs of the backlight light source corresponding to a video display area so as to illuminate the changed video display area and turns off LEDs of the backlight light source corresponding to the region outside the video display area.

PRIOR ART DOCUMENT

Patent Document

Patent Document 1: Japanese Laid-Open Patent Publication No. 2001-21863

SUMMARY OF THE INVENTION

Problem to be Solved by the Invention

FIG. 10 is a diagram explaining a problem in the case of displaying a video in a restricted video display area of the liquid crystal panel disposed on a conventional liquid crystal display device.

FIG. 10(A) is a diagram depicting a state where a video according to input video data is displayed in a restricted video display area 101 of a liquid crystal panel 100. A liquid crystal drive control portion (not depicted) of the liquid crystal display device controls the voltage applied to liquid crystal pixels of the video display area 101 so that a video is displayed in the video display area 101. The liquid crystal drive control portion controls the voltage applied to liquid crystal pixels lying in a region 102 outside the sub-screen video display area (hereinafter, referred to as the region outside the video display area) so that a black image is displayed in the region 102 outside the video display area.

FIG. 10(B) is a diagram depicting a state of light emission of a backlight unit 110 that illuminates the liquid crystal panel 100 currently displaying a video.

The backlight unit 110 has a plurality of light emitting elements each designated by a circle C, the light emitting elements being arranged in a matrix manner directly under the liquid crystal panel 100. The backlight unit 110 is a so-called direct-type backlight that is placed on the back of the liquid crystal panel 100 in an overlapping manner. A white circle designates a state where the light emitting element is on, while a gray circle designates a state where it is off.

In this case, a light emission control portion (not depicted) of the backlight unit 110 is capable of individually controlling the luminance value of each light emitting element. Then, the light emission control portion controls the luminance value of the light emitting element of the backlight unit 110 so as to illuminate only the video display area 101.

As is apparent from FIGS. 10(A) and 10(B), a vertical width L1 and a horizontal width W1 of the video display area 101 are respectively equal to a vertical width L1 and a horizontal width W1 of an illumination area 111 of the light emitting elements (white circles) illuminating the video display area 101 in the backlight unit 110 such that the video display area 101 and the illumination area 111 completely overlap each other.

FIG. 10(C) represents graphs taken along a dashed dotted line P of FIG. 10(A), from top to bottom, a graph of the apparent brightness (luminance, illuminance) of the liquid crystal panel 100 currently displaying a video, a graph of the aperture ratio (transmittance) of the liquid crystal pixel, and a graph of the luminance value of the light emitting elements of the backlight unit 110, with the lighting state of the light emitting elements being shown below the luminance value graph. As is apparent from the graph of the liquid crystal pixel aperture ratio, an aperture ratio of the liquid crystal pixel lying in the region 102 outside the video display area is set to 0.

In such a backlight unit 110, there occurs a so-called light leakage, as designated by dots D in the luminance value graph of FIG. 10(C), that light from the light emitting elements in action leaks into a region corresponding to the light emitting elements out of action.

Even though the aperture ratio is set to 0 of the liquid crystal pixels lying in the region 102 outside the video display area of the liquid crystal panel 100, it is difficult from the liquid crystal characteristics to have a light transmittance of 0, that is, to thoroughly shut off light, disadvantageously allowing a part of light arising from the light leakage to pass through the liquid crystal pixels lying in the region 102 outside the video display area.

As a result, as seen in the apparent brightness graph of FIG. 10(C), in a peripheral region 103 corresponding to the light leakage of the video display area 101, it gradually becomes dark (dimly darkens) according as going away from the video display area 101, with its deep black outside, giving a viewer an incongruous feeling.

Provided that the light leakage can be perfectly shut off, the region 102 outside the video display area becomes pitch dark as depicted in FIG. 11, not giving the incongruous feeling to the viewer. It is, however, technically difficult to perfectly shut off the light leakage.

There is a case where the illumination area of the backlight unit 110 illuminating the video display area 101 becomes wider than the video display area 101 so that the region outside the video display area 101 may also be illuminated. This may occur when simplifying the circuit configuration of the light emission control portion (not depicted) of the backlight unit 110 in cases where a plurality of adjacent light emitting elements are collected together for the light emission control (block light emission control) or where the backlight unit 110 has a less number of light emitting elements.

FIG. 12(A) is a diagram depicting a light emitting state of the backlight unit 120 in the case where the illumination area of the backlight unit 120 is wider than that of the video display area 101. At the center of the liquid crystal panel 100, as depicted in FIG. 10(A), there appears the video display area 101 having the vertical width L1 and the horizontal width W1.

FIG. 12(B) is a diagram depicting the light emission state of the backlight unit 120 illuminating the liquid crystal panel 100.

FIG. 12(C) represents graphs taken along a dashed dotted line P of FIG. 12(A), from top to bottom, a graph of the apparent brightness of the liquid crystal panel 100 currently displaying a video, a graph of the aperture ratio of the liquid crystal pixels, and a graph of the luminance value of the light emitting elements of the backlight unit 110, with the lighting state of the light emitting elements being shown below the luminance value graph.

As is apparent from the diagrams of FIG. 12, a vertical width L2 and a horizontal width W2 of an illumination area 121 of the light emitting elements illuminating the video display area 101 are larger than the vertical width L1 and the horizontal width W1 of the video display area 101, with the result that not only the video display area 101 but also the proximate region outside the video display area are illuminated.

In such a case, the region outside the video display area 101 is also illuminated by the light emitting elements and, therefore, a light leakage occurs, as a result of which a dimly dark peripheral region 104 becomes large, easily giving the viewer the incongruous feeling.

The present invention was conceived in view of the above circumstances and it is an object thereof to reduce the incongruous feeling of a viewer caused by the light leakage in the liquid crystal display device having the local dimming function.

Means for Solving the Problem

A first technical means of the present invention is a liquid crystal display device comprising a liquid crystal panel displaying video data, a backlight unit having a plurality of light emitting elements arranged thereon for illuminating the liquid crystal panel, a video display control portion displaying a video as a sub-screen in a restricted video display area of the liquid crystal panel, and a backlight control portion controlling a light emission luminance of the light emitting elements of the backlight unit in response to control of the video display control portion, wherein the video display control portion controls an aperture ratio of a liquid crystal pixel lying in a region outside a sub-screen video display area to be a predetermined value, the backlight control portion controls a luminance value of light emitting element illuminating the region outside the sub-screen video display area to be a predetermined value in response to the control of the video display control portion, and a luminance of the region outside the sub-screen video display area is controlled to be a predetermined value, based on a correlation between the aperture ratio of the liquid crystal pixel lying in the region outside the sub-screen video display area, controlled by the video display control portion, and the luminance value of the light emitting element illuminating the region outside the sub-screen video display area, controlled by the backlight control portion.

A second technical means is the liquid crystal display device of the first technical means, wherein the control of the luminance of the region outside the sub-screen video display area is carried out only by the control of the aperture ratio of the liquid crystal pixel lying in the region outside the sub-screen video display area by the video display control portion or only by the control of the luminance value of the light emitting element illuminating the region outside the sub-screen video display area by the backlight control portion.

A third technical means is the liquid crystal display device of the first or second technical means, wherein the control of the aperture ratio of the liquid crystal pixel lying in the region outside the sub-screen video display area by the video display control portion is provided in accordance with the luminance value of the light emitting element illuminating the region outside the sub-screen video display area and/or with the luminance value of a light leakage of light emission from the light emitting element for illuminating a display video in the video display area.

A fourth technical means is the liquid crystal display device of the third technical means, wherein control of the aperture ratio of liquid crystal pixel lying on a site corresponding to a region illuminated by the light leakage is provided so as to gradually increase according as going away from the video display area for at least a certain stretch, opposite to a variation in the luminance value of the light leakage that gradually decreases according as going away from the video display area.

A fifth technical means is the liquid crystal display device of the first or second technical means, wherein the control of the aperture ratio of the liquid crystal pixel by the video display control portion and/or the control of the luminance value of the light emitting element by the backlight control portion is executed in such a manner that the luminance value of the region outside the sub-screen video display area of the liquid crystal panel is constant or gradually decreases according as going away from the video display area for at least a certain stretch.

A sixth technical means is the liquid crystal display device of the first or second technical means, wherein the control of the aperture ratio of the liquid crystal pixel by the video display control portion and/or the control of the luminance value of the light emitting element by the backlight control portion is effected in such a manner as to border a peripheral region around the video display area of the liquid crystal panel.

A seventh technical means is the liquid crystal display device of the first or second technical means, wherein in order to illuminate a display video lying in the video display area, the backlight control portion causes light emitting element corresponding to the video display area to emit light or causes the light emitting element corresponding to the video display area and light emitting element corresponding to a proximate region outside the video display area to emit light.

An eighth technical means is the liquid crystal display device of the first or second technical means, wherein in order to illuminate a display video lying in the video display area, the backlight control portion causes light emitting element corresponding to an inner region inside the video display area to emit light.

A ninth technical means is the liquid crystal display device of the first or second technical means, comprising a memory portion storing background image data to be displayed in the region outside the sub-screen video display area, wherein the video display control portion displays the background image data of the memory portion in the region outside the sub-screen video display area.

Effect of the Invention

According to the present invention, in the liquid crystal display device having the local dimming function, there can be relieved an incongruous feeling that the viewer experiences due to a light leakage, by controlling the aperture ratio of the liquid crystal pixels and the luminance value of the light emitting elements.

MODE FOR CARRYING OUT THE INVENTION

Example 1

Figure 1:
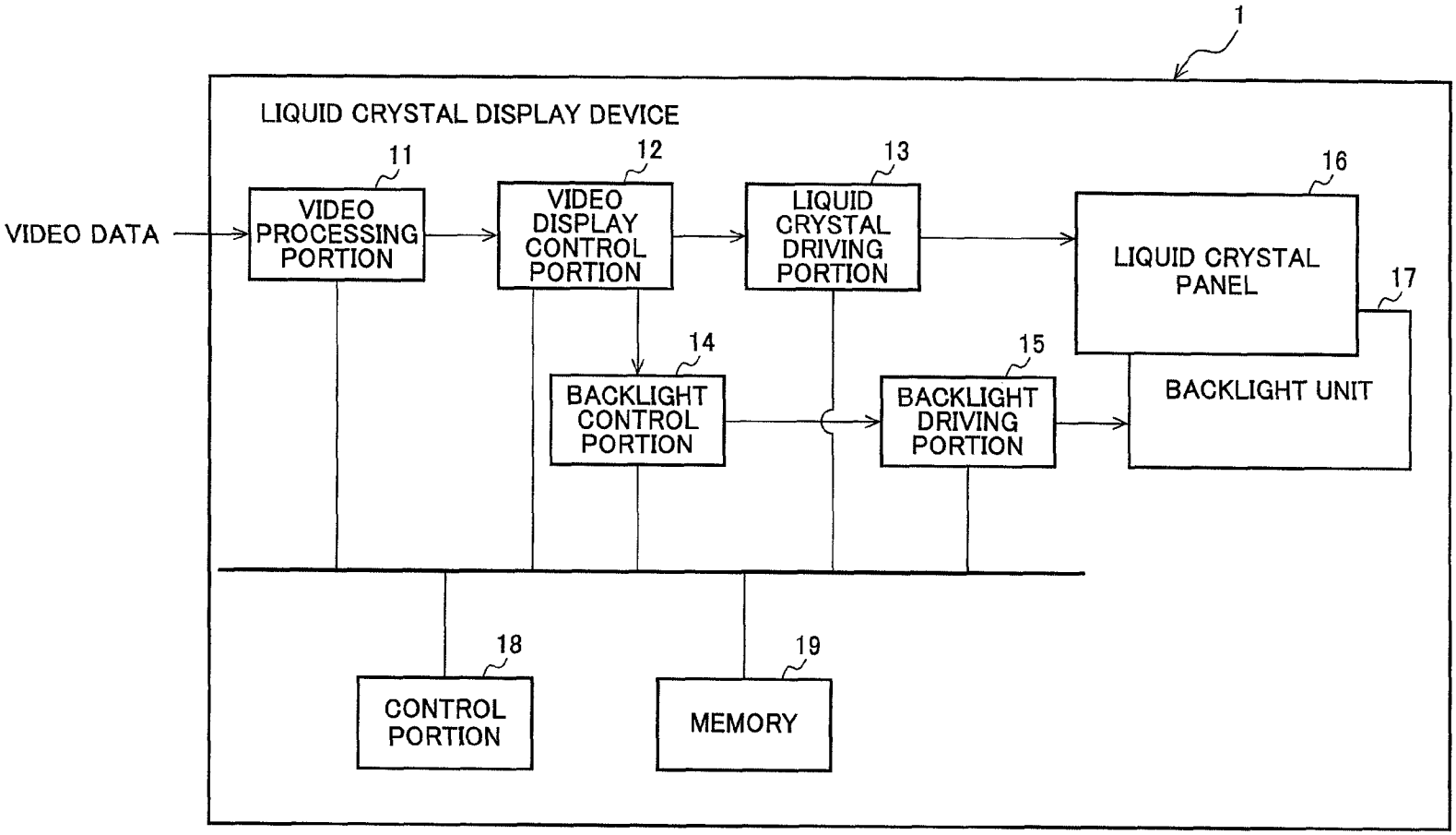
FIG. 1 is a functional block diagram of a liquid crystal display device according to the present invention.

FIG. 1 depicts, as an example, a functional block diagram of a liquid crystal display device according to the present invention.

A liquid crystal display device 1 includes a video processing portion 11, a video display control portion 12, a liquid crystal driving portion 13, a backlight control portion 14, a backlight driving portion 15, a liquid crystal panel 16, a backlight unit 17, a control portion 18, and a memory 19.

The video processing portion 11 performs various video processing for input video data such as color space transform, γ-correction, and color correction, to output the video data undergoing the various video processing to the video display control portion 12. As set forth hereinabove, in the case of displaying a video as a sub-screen in a restricted video display area (hereinafter, referred to as video display area) of the liquid crystal panel 16, video data corresponding to the video display area is generated and the generated video data is output to the video data display control portion 12.

The video display control portion 12 generates a control signal (image signal) for controlling the liquid crystal driving portion 13 and the backlight control portion 14 such that a video according to the video data from the video processing portion 11 is displayed on the liquid crystal panel 16, and outputs the generated control signal to the liquid crystal driving portion 13 and the backlight control portion 14.

In the case of displaying a video in the video display area of the liquid crystal panel 16, the video display control portion 12 generates a control signal for controlling the liquid crystal driving portion 13 and the backlight control portion 14 such that the video is displayed in this video display area, and outputs the generated control signal to the liquid crystal driving portion 13 and the backlight control portion 14. At that time, the video display control portion 12 generates a control signal (image signal) for controlling the aperture ratio of the liquid crystal pixels lying in a region outside the image display area displaying a video (hereinafter, referred to as the region outside the image display area) to be a predetermined value, and outputs the generated control signal to the liquid crystal driving portion 13. The details thereof will be described later.

Based on the control signal output from the video display control portion 12, the liquid crystal driving portion 13 generates gray scale data and a signal line control signal output to a source driver (not depicted) and a scan line control signal output to a gate driver (not depicted) and controls the aperture ratio of the liquid crystal pixels of the liquid crystal panel 16, to display a video on the liquid crystal panel 16.

In response to the control signal output from the video display control portion 12, the backlight control portion 14 outputs a backlight driving signal for controlling the luminance value of the light emitting elements of the backlight unit 17 to the backlight driving portion 15.

When displaying a video in the video display area of the liquid crystal panel 16, the backlight control portion 14 generates, in accordance with the control of the video display control portion 12, a backlight driving signal for controlling the luminance value of the light emitting elements illuminating the region outside the video display area to be a predetermined value, and outputs it to the backlight driving portion 15. The details thereof will be described later.

The backlight driving portion 15 controls, based on the backlight driving signal, the luminance value of each of the light emitting elements of the backlight unit 17.

The liquid crystal panel 16 is made up of, e.g., a top glass substrate, a bottom glass substrate, a liquid crystal layer interposed between the glass substrates, and a polarizing plate that polarizes light. The top glass substrate is mounted with color filters of R (red), G (green), and B (blue) so that various hues can be represented by the combination of shades of color depending on the quantity of light passing through the liquid crystal pixels.

Figure 10:
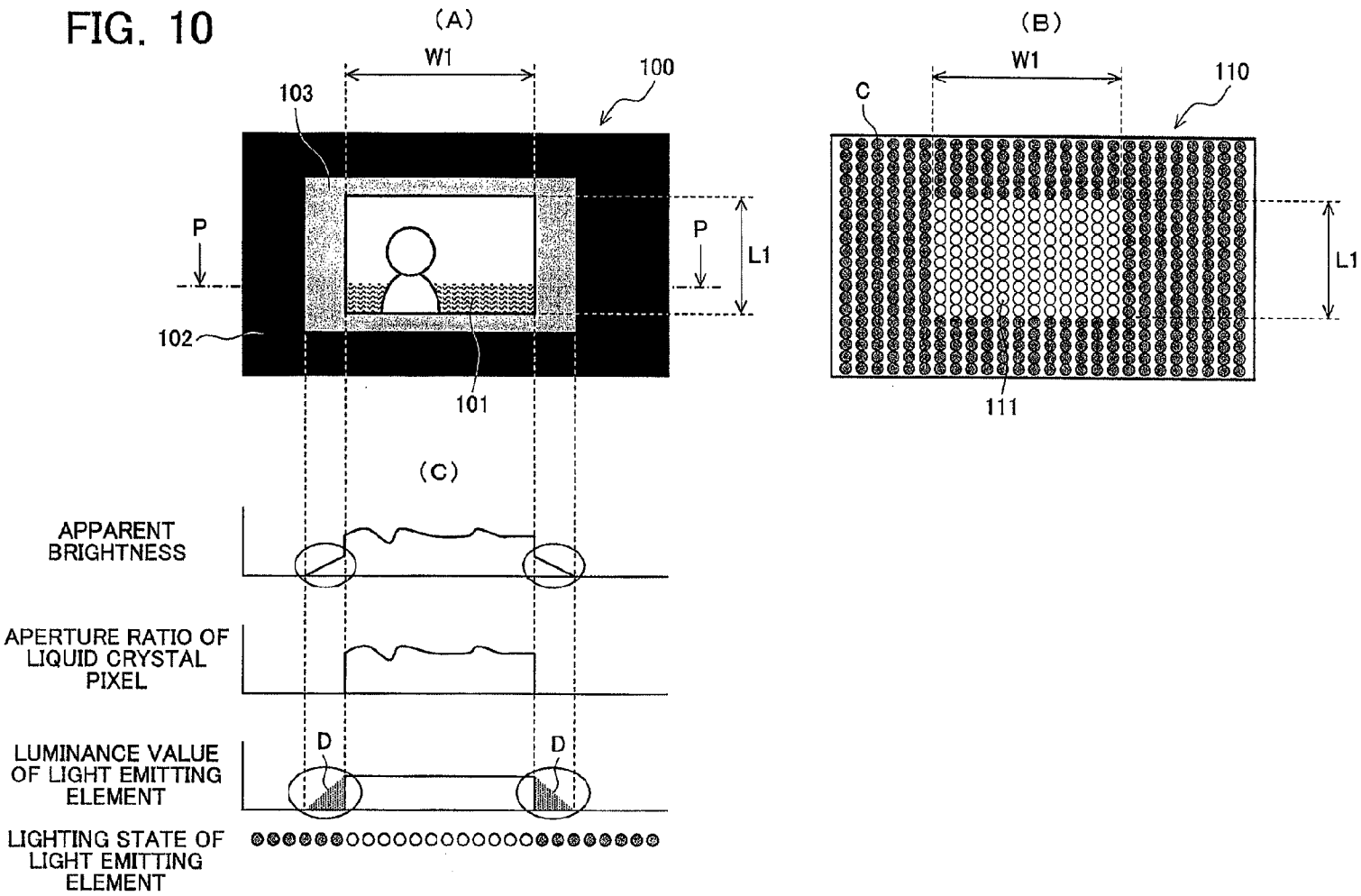
FIG. 10 is a diagram explaining a problem in the case of displaying a video in a restricted video display area of the liquid crystal panel.
Figure 11:
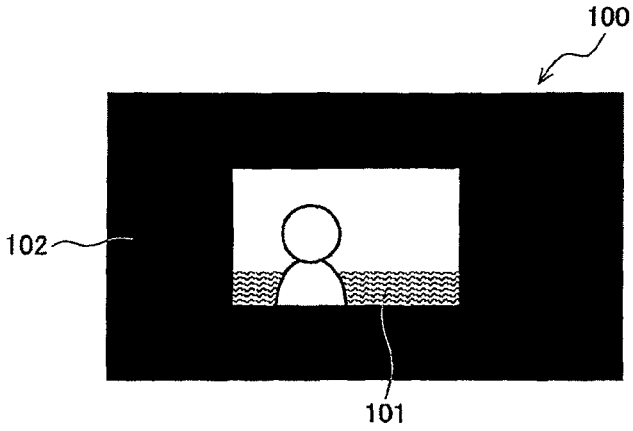
FIG. 11 is a diagram depicting a state where no light leakage occurs when the video is displayed.

The backlight unit 17 has, as described in FIG. 10, a plurality of light emitting elements illuminating the liquid crystal panel 16, the light emitting elements being arranged in a matrix manner directly under the liquid crystal panel 16. The backlight unit 17 is a so-called direct-type backlight that is placed on the back of the liquid crystal panel 16 in an overlapping manner, but it may be a backlight other than the direct type. A diffusing plate and a prism sheet both not depicted are disposed between the liquid crystal panel 16 and the backlight unit 17. The diffusing plate acts to disperse and diffuse illumination light from the backlight unit 17 to impart a uniform brightness to the entire display area. The prism sheet acts to improve the luminance of the illumination light from the backlight unit 17.

The control portion 18 controls the function blocks, and the memory 19 stores various types of control information, etc.

The liquid crystal display device 1 according to the present invention controls the luminance of the region outside the video display area to be a predetermine value, based on the correlation between the aperture ratio of the liquid crystal pixels in the region outside the video display area controlled by the video display control portion 12 and the luminance value of the light emitting elements illuminating the region outside the video display area controlled by the backlight control portion 14. The luminance of the region outside the video display area may be controlled to be a predetermined value merely by controlling the aperture ratio of the liquid crystal pixels in the region outside the video display area by the video display control portion 12 or merely by controlling the luminance value of the light emitting elements illuminating the region outside the video display area by the backlight control portion 14.

Specifically, the video display control portion 12 may control the aperture ratio of the liquid crystal pixels in the region outside the video display area depending on the luminance value of the light leakage of light emitted from the light emitting elements for illuminating the display video in the video display area, and/or it may control the aperture ratio of the liquid crystal pixels in the region outside the video display area depending on the luminance value of the light emitting elements illuminating the region outside the video display area.

For example, the video display control portion 12 controls the aperture ratio of the liquid crystal pixels lying in a region (hereinafter, referred to as the light leakage corresponding region) of the liquid crystal panel 16 corresponding to the area illuminated by the light leakage so as to gradually increase for at least a certain stretch according as going away from the video display area, opposite to the change of the luminance value of the light leakage that gradually decreases according as going away from the video display area.

Detailed description will now be provided mainly to the control of the aperture ratio of the liquid crystal pixels with reference to the drawings.

In Example 1, the case will exemplarily be described where, as depicted in FIG. 10, the backlight control portion 14 causes light emitting elements corresponding to a video display area to emit light in order to illuminate a display video of the video display area.

Figure 2:
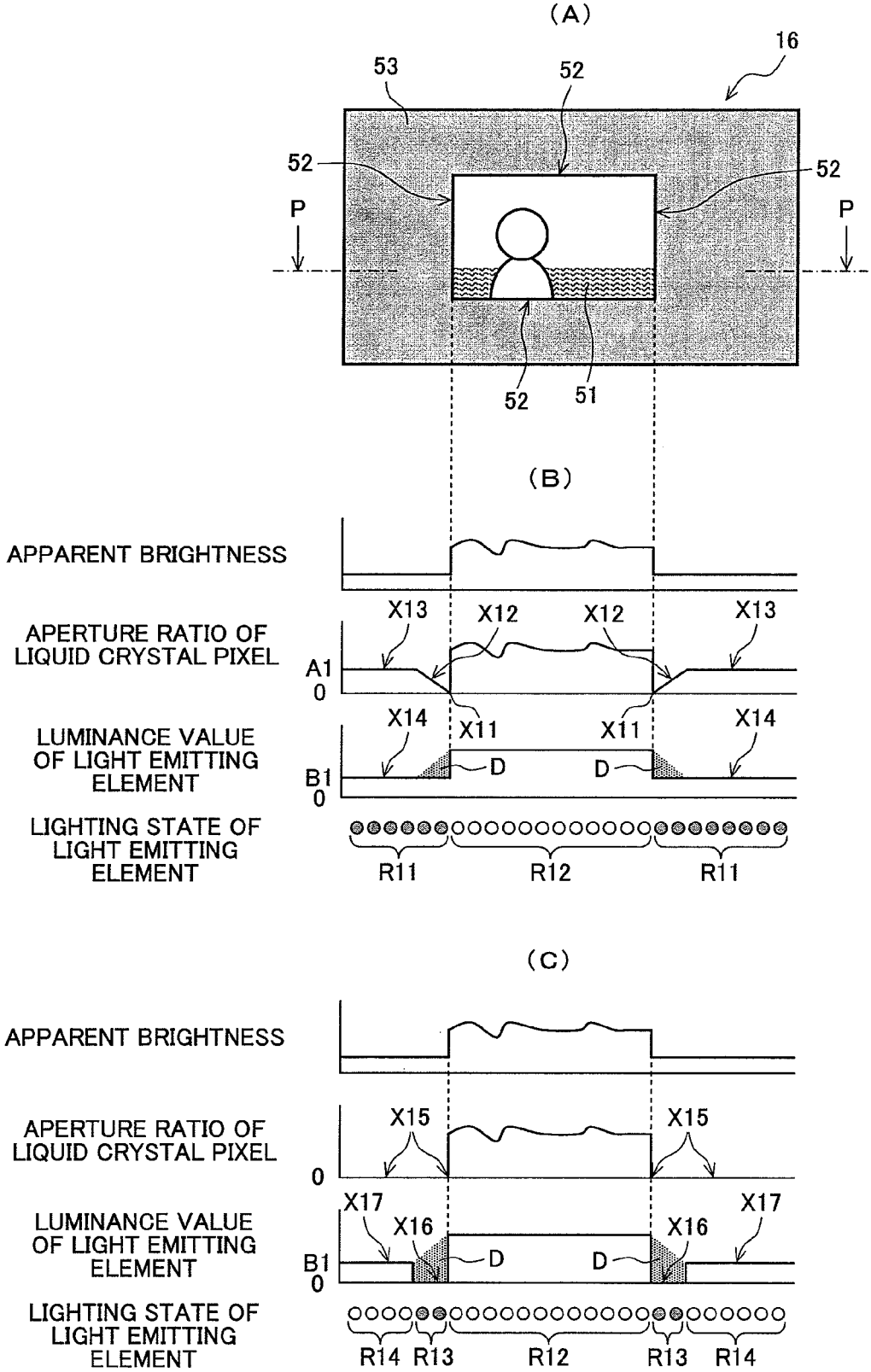
FIG. 2 is a diagram explaining the display state of a liquid crystal panel, the aperture ratio of liquid crystal pixels, and the luminance value of light emitting elements.

FIG. 2(A) is a diagram depicting a state where, in the case of applying the present invention, a video according to input video data is displayed in a video display area 51 of the liquid crystal panel 16, reference numeral 52 denoting an area edge of the video display area 51, and reference numeral 53 denoting a region outside the video display area.

FIG. 2(B) represents, from top to bottom, graphs taken along a dashed dotted line P of FIG. 2(A), a graph of the apparent brightness (luminance, illuminance) of the liquid crystal panel 16 currently displaying a video, a graph of the aperture ratio of the liquid crystal pixels, and a graph of the luminance value of the light emitting elements of the backlight unit 17, with the lighting state of the light emitting elements being shown below the luminance value graph. Dots D depicted in the graph of the luminance value of the light emitting elements designates a light leakage whose luminance value varies so as to gradually decrease according as going away from the video display area. Graphs, etc., depicted in FIG. 2(C) are the same as the graphs, etc., depicted in FIG. 2(B).

The video display control portion 12 controls the aperture ratio of the liquid crystal pixels lying on the area edge 52 of the video display area 51 to be a first predetermined aperture ratio (e.g., 0), as designated by reference alphanumeral X11 of FIG. 2(B). Furthermore, the video display control portion 12 gradually increases the aperture ratio of the liquid crystal pixels of the light leakage corresponding region in the region 53 outside the video display area until reaching a second predetermined aperture ratio (e.g., A1) according as going away from the video display area 51, as designated by reference alphanumeral X12 of the diagram, opposite to the variation (see dots D) in the luminance value of the light leakage that gradually decreases according as going away from the video display area 51. Then, the video display control portion 12 controls the aperture ratio of the liquid crystal pixels of regions other than the light leakage corresponding region in the region 53 outside the video display area to be constant, as designated by reference alphanumeral X13 of the diagram.

The backlight control portion 14 controls the luminance value of light emitting elements R11 illuminating the region 53 outside the video display area to be a third predetermined luminance value (e.g., B1) less than or equal to the luminance value of light emitting elements R12 illuminating the video display area 51, as designated by reference alphanumeral X14 of FIG. 2(B).

Thus, the apparent brightness (luminance) of the region 53 outside the video display area results in a constant value, as seen from the apparent brightness graph of FIG. 2(B), from the correlation between the aperture ratio of the liquid crystal pixels in the region outside the video display area controlled by the video display control portion 12 and the luminance value of the light emitting elements illuminating the region outside the video display area controlled by the backlight control portion 14. As a result, it looks as if a uniform gray color image is displayed, rendering the light leakage inconspicuous.

Otherwise, as will be described in FIG. 2(C), the apparent brightness of the region 53 outside the video display area may be uniformed by controlling the aperture ratio of the liquid crystal pixels and the luminance value of the light emitting elements.

The video display control portion 12 controls the aperture ratio of the liquid crystal pixels lying on the area edge 52 of the video display area 51 and the aperture ratio of the liquid crystal pixels lying in the region 53 outside the video display area to be the first predetermined aperture ratio (e.g., 0), as designated by reference alphanumeral X15 of FIG. 2(C).

The backlight control portion 14 controls the luminance value of outside light emitting elements R13 outside the light emitting elements R12 illuminating the video display area 51 to be a fourth predetermined luminance value (e.g., 0) less than or equal to the luminance value of the light emitting elements R12, as designated by reference alphanumeral X16. Furthermore, the backlight control portion 14 controls the luminance value of light emitting elements R14 lying outside the outside light emitting elements R13 to be the third predetermined luminance value (e.g., B1) higher than the fourth predetermined luminance value, as designated by reference alphanumeral X17.

This enables the apparent brightness of the region 53 outside the video display area to be constant, rendering the light leakage inconspicuous.

Description will then be provided to explain a method for controlling the liquid crystal aperture ratio and the luminance value that renders the light leakage unremarkable by displaying an image that borders the peripheral region of the video display area 51.

Figure 3:
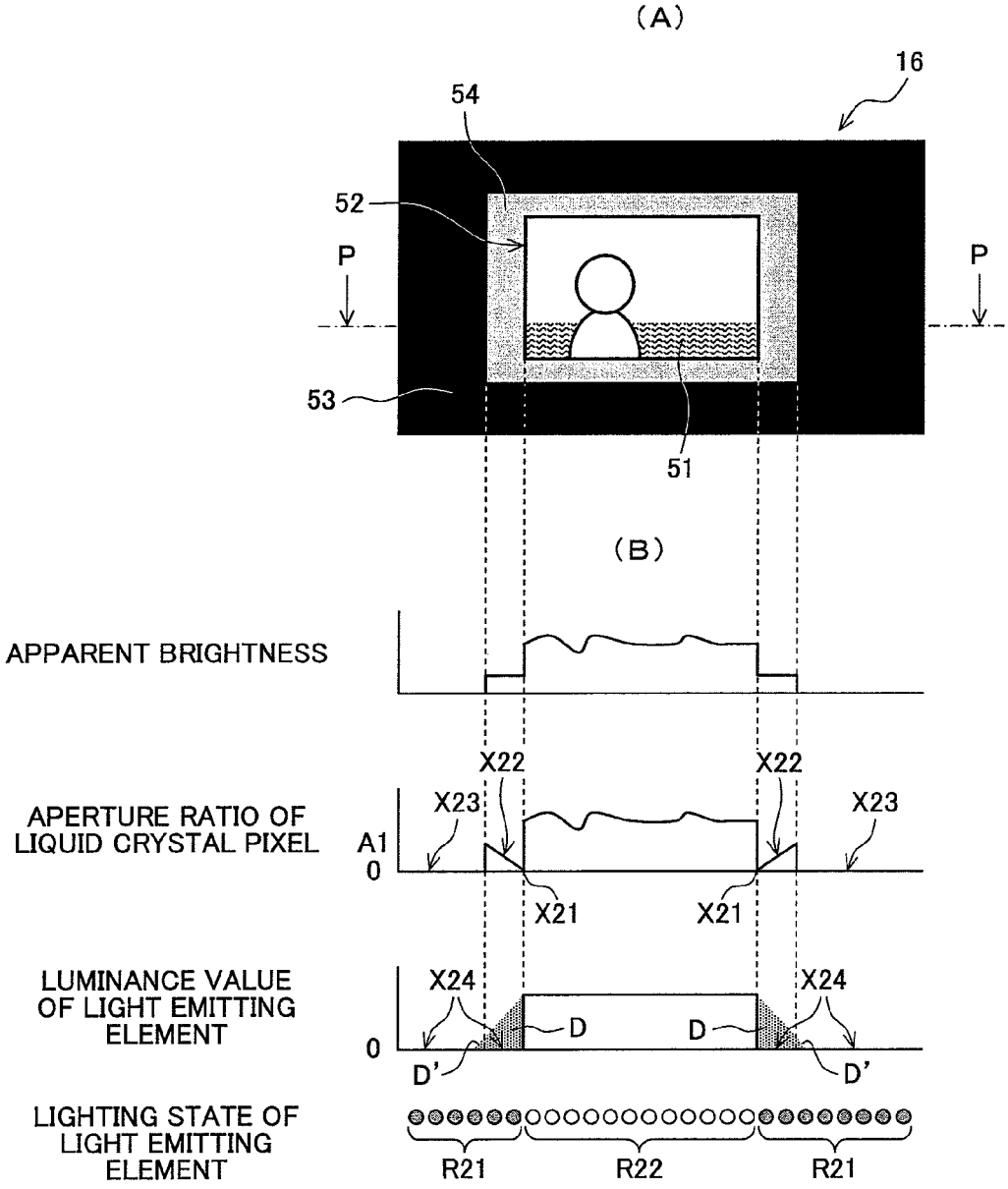
FIG. 3 is another diagram explaining the display state of the liquid crystal panel, the aperture ratio of the liquid crystal pixels, and the luminance value of the light emitting elements.

FIG. 3(A) depicts the liquid crystal panel 16 currently displaying an image that borders the peripheral region of the video display area 51 (hereinafter, referred to as the bordering image), with reference numeral 54 denoting a bordering image display region.

FIG. 3(B) depicts, similar to the graphs of FIG. 2(B), a graph of the apparent brightness, a graph of the aperture ratio of the liquid crystal pixels, a graph of the luminance value of the light emitting elements, and the lighting state of the light emitting elements.

The video display control portion 12 controls the aperture ratio of the liquid crystal pixels lying on the area edge 52 of the video display area 51 to be the first predetermined aperture ratio (e.g., 0), as designated by reference alphanumeral X21 of FIG. 3(B). Furthermore, the video display control portion 12 gradually increases the aperture ratio of the liquid crystal pixels of the light leakage corresponding region in the region 53 outside the video display area until reaching the second predetermined aperture ratio (e.g., A1) according as going away from the video display area 51, as designated by reference alphanumeral X22 of the diagram, opposite to the variation (see dots D) in the luminance value of the light leakage. Then, the video display control portion 12 controls the aperture ratio of the liquid crystal pixels of regions other than the light leakage corresponding region in the region 53 outside the video display area to be constant at the first predetermined aperture ratio, as designated by reference alphanumeral X23 of the diagram.

The backlight control portion 14 controls the luminance value of light emitting elements R21 illuminating the region 53 outside the video display area to be the fourth predetermined luminance value (e.g., 0) less than or equal to the luminance value of light emitting elements R22 illuminating the video display area 51, as designated by reference alphanumeral X24 of the diagram.

Since the luminance value of the light leakage designated by dots D' corresponding to the region 53 outside the video display area is extremely small (less than that of natural light), it is shut off by the aperture ratio control of the liquid crystal pixels of the liquid crystal panel 16, not causing any influence on the apparent brightness.

The apparent brightness (luminance) of the bordering image display region 54 results in a constant value, as seen from the apparent brightness graph of FIG. 3(B), from the correlation between the aperture ratio of the liquid crystal pixels in the region outside the video display area controlled by the video display control portion 12 and the luminance value of the light emitting elements illuminating the region outside the video display area controlled by the backlight control portion 14. As a result, it looks as if the peripheral region of the video display area 51 is bordered, rendering the light leakage inconspicuous.

Description will then be provided to explain a method for controlling the liquid crystal aperture ratio and the luminance value that renders the light leakage unremarkable by allowing a gradation image whose apparent brightness gradually darkens according as going away from the video display area 51 to appear to be displayed in the region 53 outside the video display area.

FIG. 4(A) depicts a state where the gradation image appears to be displayed in the region 53 outside the video display area, and FIG. 4(B) depicts, similar to the graphs of FIG. 2(B), a graph of the apparent brightness, a graph of the aperture ratio of the liquid crystal pixels, a graph of the luminance value of the light emitting elements, and the lighting state of the light emitting elements.

The video display control portion 12 controls the aperture ratio of the liquid crystal pixels lying on the area edge 52 of the video display area 51 to be the first predetermined aperture ratio (e.g., 0), as designated by reference alphanumeral X31 of FIG. 4(B). Furthermore, the video display control portion 12 gradually increases the aperture ratio of the liquid crystal pixels of the light leakage corresponding region in the region 53 outside the video display area until reaching the second predetermined aperture ratio (e.g., A1) according as going away from the video display area 51, as designated by reference alphanumeral X32 of the diagram, opposite to the variation (see dots D) in the luminance value of the light leakage. Then, the video display control portion 12 controls the aperture ratio of the liquid crystal pixels of regions other than the light leakage corresponding region in the region 53 outside the video display area to gradually decrease from the second predetermined aperture ratio according as apart from the video display area 51, as designated by reference alphanumeral X33 of the diagram.

The backlight control portion 14 controls the luminance value of light emitting elements R31 illuminating the region 53 outside the video display area to be the third predetermined luminance value (e.g., B1) less than or equal to the luminance value of light emitting elements R32 illuminating the video display area 51, as designated by reference alphanumeral X34 of FIG. 4(B).

Otherwise, the backlight control portion 14 may control the luminance value of the light emitting elements R31 illuminating the region 53 outside the video display area to gradually decrease according as apart from the light emitting elements R32 illuminating the video display area 51, as designated by reference alphanumeral X35 of FIG. 4(B).

The apparent brightness (luminance) decreases according as apart from the video display area 51, as seen from the apparent brightness graph of FIG. 4(B), from the correlation between the aperture ratio of the liquid crystal pixels in the region outside the video display area controlled by the video display control portion 12 and the luminance value of the light emitting elements illuminating the region outside the video display area controlled by the backlight control portion 14. As a result, it looks as if the gradation image is displayed, rendering the light leakage inconspicuous.

Example 2

Figure 5:
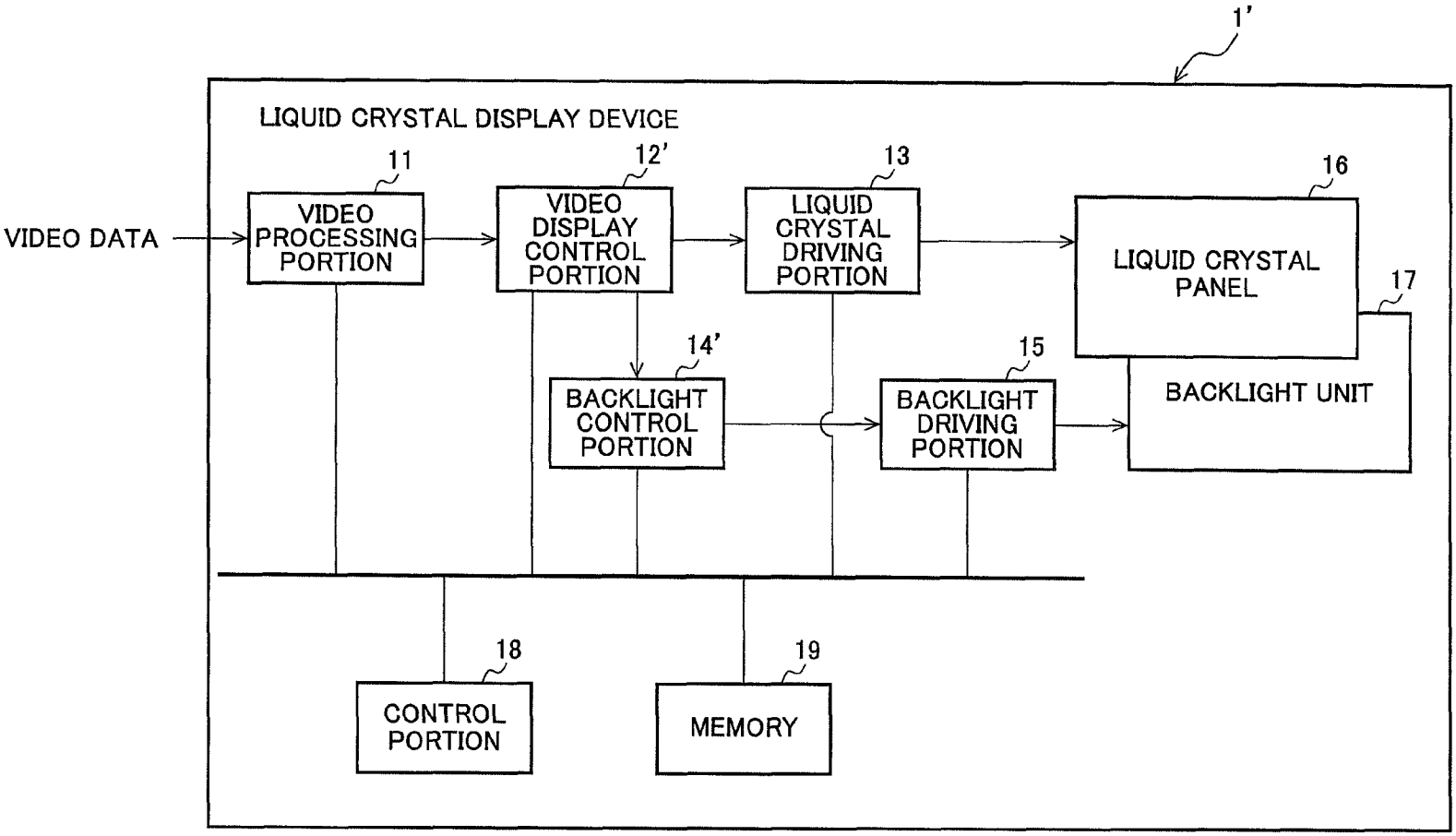
FIG. 5 is another functional block diagram of a liquid crystal display device according to the present invention.

FIG. 5 is another function block diagram of a liquid crystal display device according to the present invention. Of function blocks of the liquid crystal display device 1', the blocks identical to those of the function block diagram of FIG. 1 are designated by the same reference numerals and will not again be described.

Figure 12:
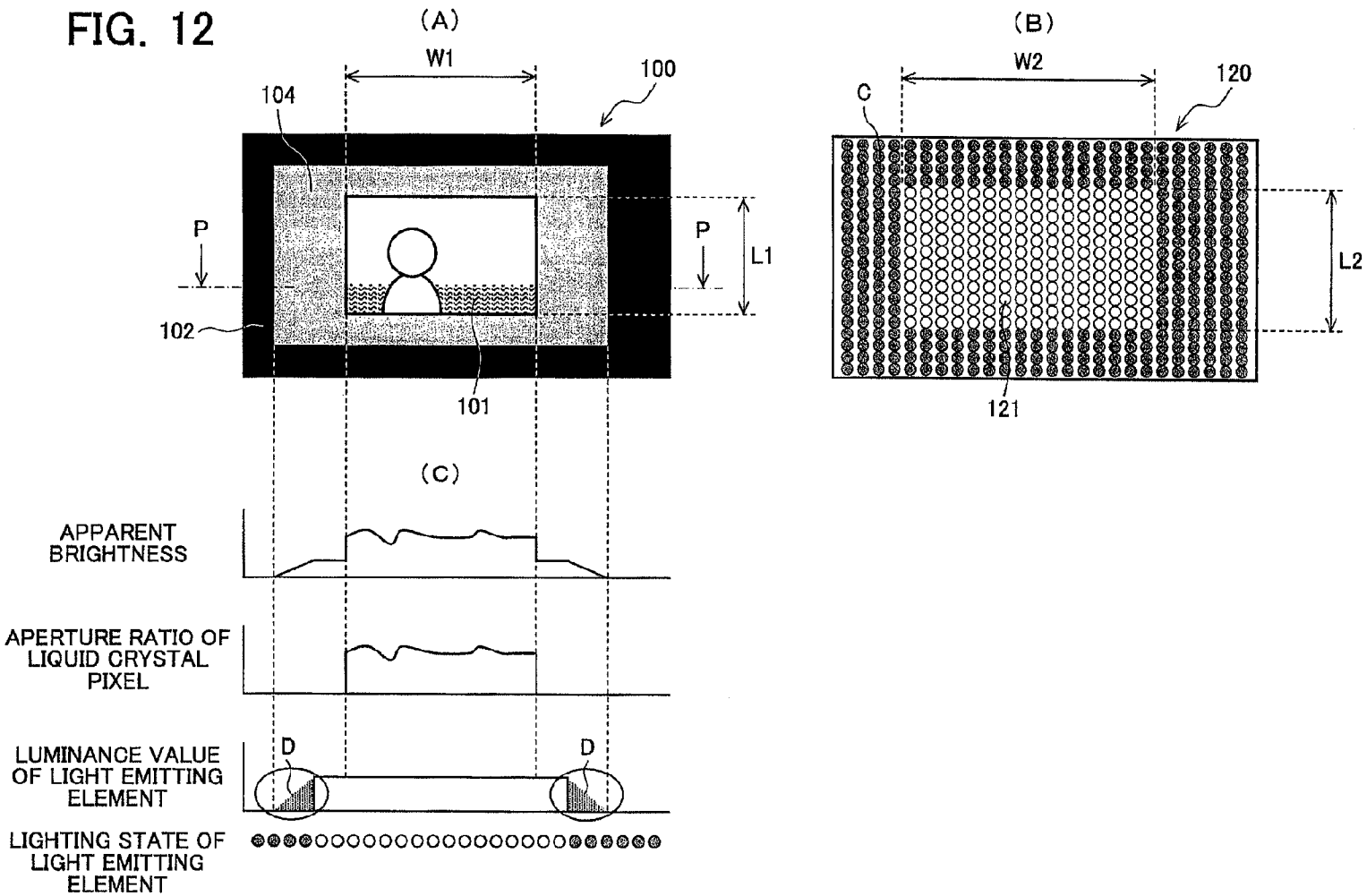
FIG. 12 is another diagram explaining a problem in the case of displaying a video in the restricted video display area of the liquid crystal panel.

The following description will be provided to explain a method for controlling the liquid crystal aperture ratio and the luminance value that renders the light leakage inconspicuous in the case where a backlight control portion 14' is compelled to illuminate not only the video display area of the liquid crystal panel 16 but also the proximate region outside the video display area such as when the light emission control is the block control or when the number of the light emitting elements is small, as set forth referring to FIG. 12.

A method will first be described of controlling the liquid crystal aperture ratio and the luminance value that renders the light leakage inconspicuous by displaying a uniform gray color image in the region 53 outside the video display area, in the same manner as in Example 1.

Figure 6:
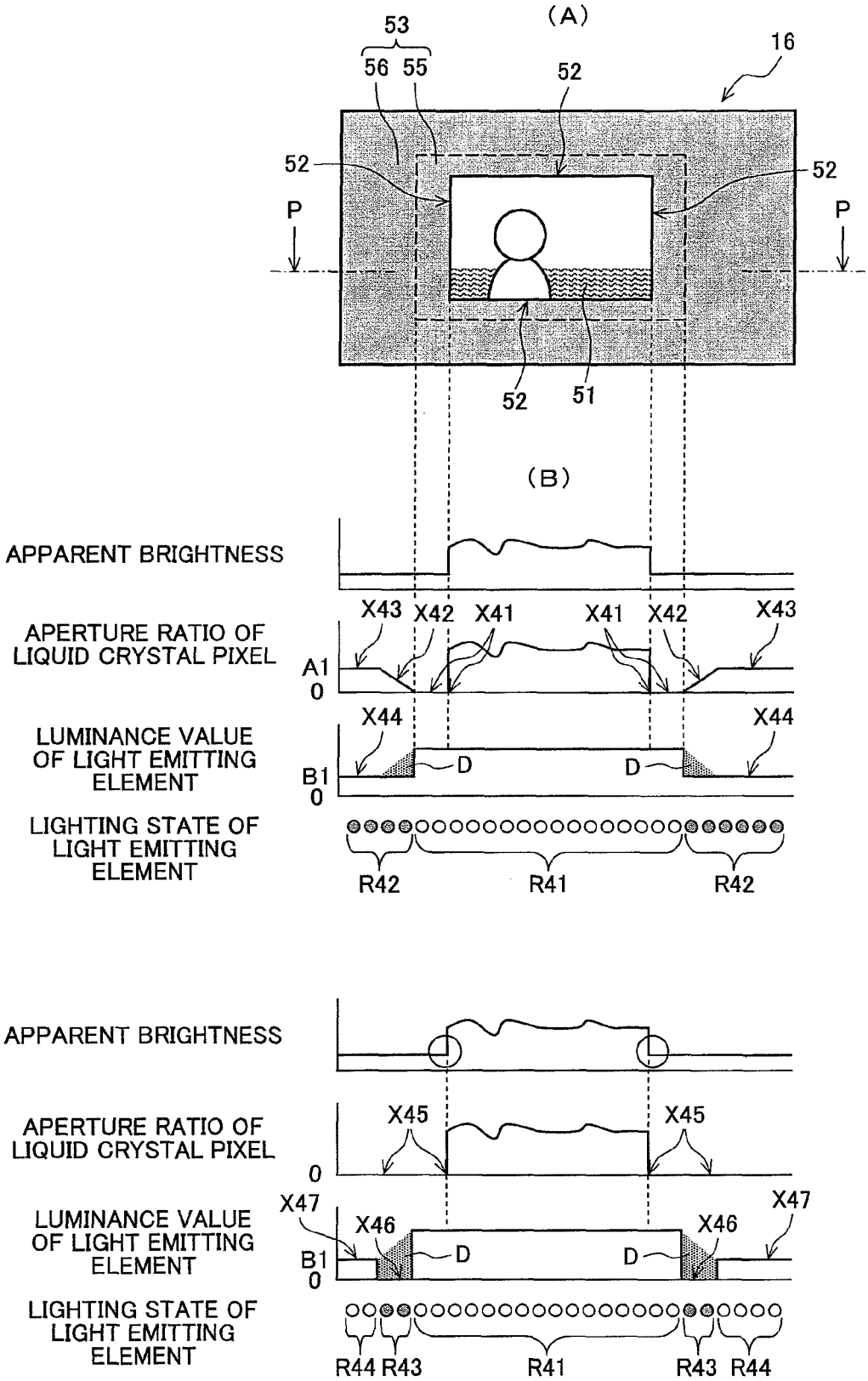
FIG. 6 is a diagram explaining the display state of the liquid crystal panel, the aperture ratio of the liquid crystal pixels, and the luminance value of the light emitting elements.

FIG. 6(A) is a diagram depicting a state where a video according to input video data is displayed on the video display area 51 of the liquid crystal panel 16. 55 denotes an outside proximate region (hereinafter, referred to as the illuminated region) outside the video display area 51 that is illuminated by light emitting elements R41 (see FIG. 6(B)) illuminating the video display area 51. 56 denotes a region (hereinafter, referred to as the region outside the illuminated region) of the region 53 outside the video display area that is not illuminated by the light emitting elements R41 illuminating the video display area 51. The region 53 outside the video display area encompasses the illuminated region 55 and the region 56 outside the illuminated region.

FIGS. 6(B) and 6(C) depict, similar to the graphs of FIG. 2(B), a graph of the apparent brightness, a graph of the aperture ratio of the liquid crystal pixels, a graph of the luminance value of the light emitting elements, and the lighting state of the light emitting elements.

A video display control portion 12' controls the aperture ratio of the liquid crystal pixels lying on the area edge 52 of the video display area 51 and the aperture ratio of the liquid crystal pixels lying on the illuminated region 55 of the region 53 outside the video display area to be the first predetermined aperture ratio (e.g., 0), as designated by reference alphanumeral X41 of FIG. 6(B). Furthermore, the video display control portion 12' gradually increases the aperture ratio of the liquid crystal pixels of the light leakage corresponding region in the region 56 outside the illuminated region until reaching the second predetermined aperture ratio (e.g., A1) according as apart from the video display area 51, as designated by reference alphanumeral X42 of the diagram, opposite to the variation (see dots D) in the luminance value of the light leakage. Then, the video display control portion 12' controls the aperture ratio of the liquid crystal pixels of regions other than the light leakage corresponding region in the region 56 outside the illuminated region to be constant at the second predetermined aperture ratio, as designated by reference alphanumeral X43 of the diagram.

Based on coordinate values of the video display area 51 and on coordinate values of the illumination range of the light emitting elements illuminating the video display area 51, the control portion 18 may figure out coordinate values of the illuminated region 55 of the region 53 outside the video display region. Otherwise, the memory 19 may store in advance coordinate values of the illuminated region 55 of the region 53 outside the video display area 53. The video display control portion 12' refers to the coordinate values of the illuminated region 55 to specify the liquid crystal pixels controlling the aperture ratio.

The backlight control portion 14' controls the luminance value of light emitting elements R42 illuminating the region 56 outside the illuminated region of the region 53 outside the video display area to be the third predetermined luminance value (e.g., B1) less than or equal to the luminance value of light emitting elements R41 illuminating the video display area 51 and the illuminated region 55, as designated by reference alphanumeral X44 of FIG. 6(B).

Thereby, as set forth in Example 1, it looks as if a uniform gray color image is displayed on the region 53 outside the video display area.

Otherwise, as described in FIG. 2(C), the apparent brightness of the region 53 outside the video display area may be uniformed by controlling the aperture ratio of the liquid crystal pixels and the luminance value of the light emitting.

The video display control portion 12' controls the aperture ratio of the liquid crystal pixels lying on the area edge 52 of the video display area 51 and the aperture ratio of the liquid crystal pixels lying in the region 53 outside the video display area to be the first predetermined aperture ratio (e.g., 0), as designated by reference alphanumeral X45 of FIG. 6(C).

The backlight control portion 14' controls the luminance value of outside light emitting elements R43 outside the light emitting elements R41 illuminating the video display area 51 and the illuminated region 55 to be the fourth predetermined luminance value (e.g., 0) less than or equal to the luminance value of the light emitting elements R41, as designated by reference alphanumeral X46. Furthermore, the backlight control portion 14' controls the luminance value of light emitting elements R44 lying outside the outside light emitting elements 43 to be the third predetermined luminance value (e.g., B1) higher than the fourth predetermined luminance value, as designated by reference alphanumeral X47.

This enables the light leakage to become inconspicuous.

Description will then be provided to explain a method for controlling the liquid crystal aperture ratio and the luminance value that renders the light leakage unremarkable by displaying the bordering image, similar to Example 1.

Figure 7:
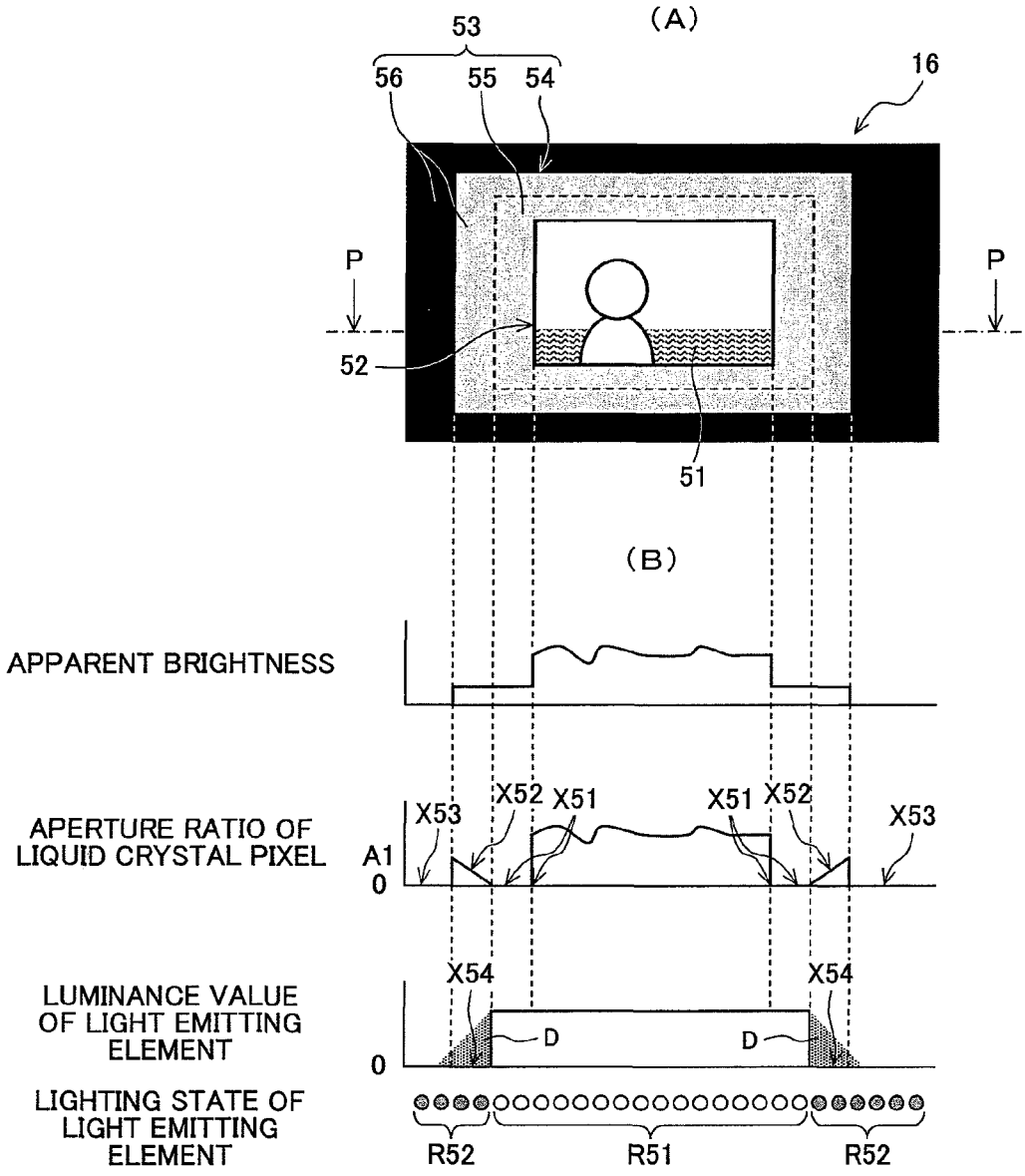
FIG. 7 is another diagram explaining the display state of the liquid crystal panel, the aperture ratio of the liquid crystal pixels, and the luminance value of the light emitting elements.

FIG. 7(A) depicts the liquid crystal panel 16 currently displaying the bordering image, with the gray colored bordering image display region 54 lying outside the video display area 51.

FIG. 7(B) depicts, similar to the graphs of FIG. 2(B), a graph of the apparent brightness, a graph of the aperture ratio of the liquid crystal pixels, a graph of the luminance value of the light emitting elements, and the lighting state of the light emitting elements.

The video display control portion 12' controls the aperture ratio of the liquid crystal pixels lying on the area edge 52 of the video display area 51 and the aperture ratio of the liquid crystal pixels lying in the illuminated region 55 of the region 53 outside the video display area to be the first predetermined aperture ratio (e.g., 0), as designated by reference alphanumeral X51 of FIG. 7(B). Furthermore, the video display control portion 12' gradually increases the aperture ratio of the liquid crystal pixels of the light leakage corresponding region in the region 56 outside the illuminated region until reaching the second predetermined aperture ratio (e.g., A1) according as apart from the video display area 51, as designated by reference alphanumeral X52 of the diagram, opposite to the variation (see dots D) in the luminance value of the light leakage. Then, the video display control portion 12' controls the aperture ratio of the liquid crystal pixels of regions other than the light leakage corresponding region in the region 56 outside the illuminated region to be constant at the first predetermined aperture ratio, as designated by reference alphanumeral X53 of the diagram.

The backlight control portion 14' controls the luminance value of light emitting elements R52 illuminating the region 56 outside the illuminated region to be the fourth predetermined luminance value (e.g., 0) less than or equal to the luminance value of light emitting elements R51 illuminating the video display area 51 and the illuminated region 55, as designated by reference alphanumeral X54 of FIG. 7(B).

At this time, as seen from the apparent brightness graph of FIG. 7(B), the brightness of the bordering image display region 54 is constant so that it looks as if there is displayed an image bordering the peripheral region of the video display area 51, with the result that the light leakage becomes inconspicuous.

Description will then be provided to explain a method for controlling the liquid crystal aperture ratio and the luminance value, the method rendering the light leakage unremarkable by allowing a gradation image to appear to be displayed in the region 53 outside the video display area, similar to Example 1.

Figure 8:
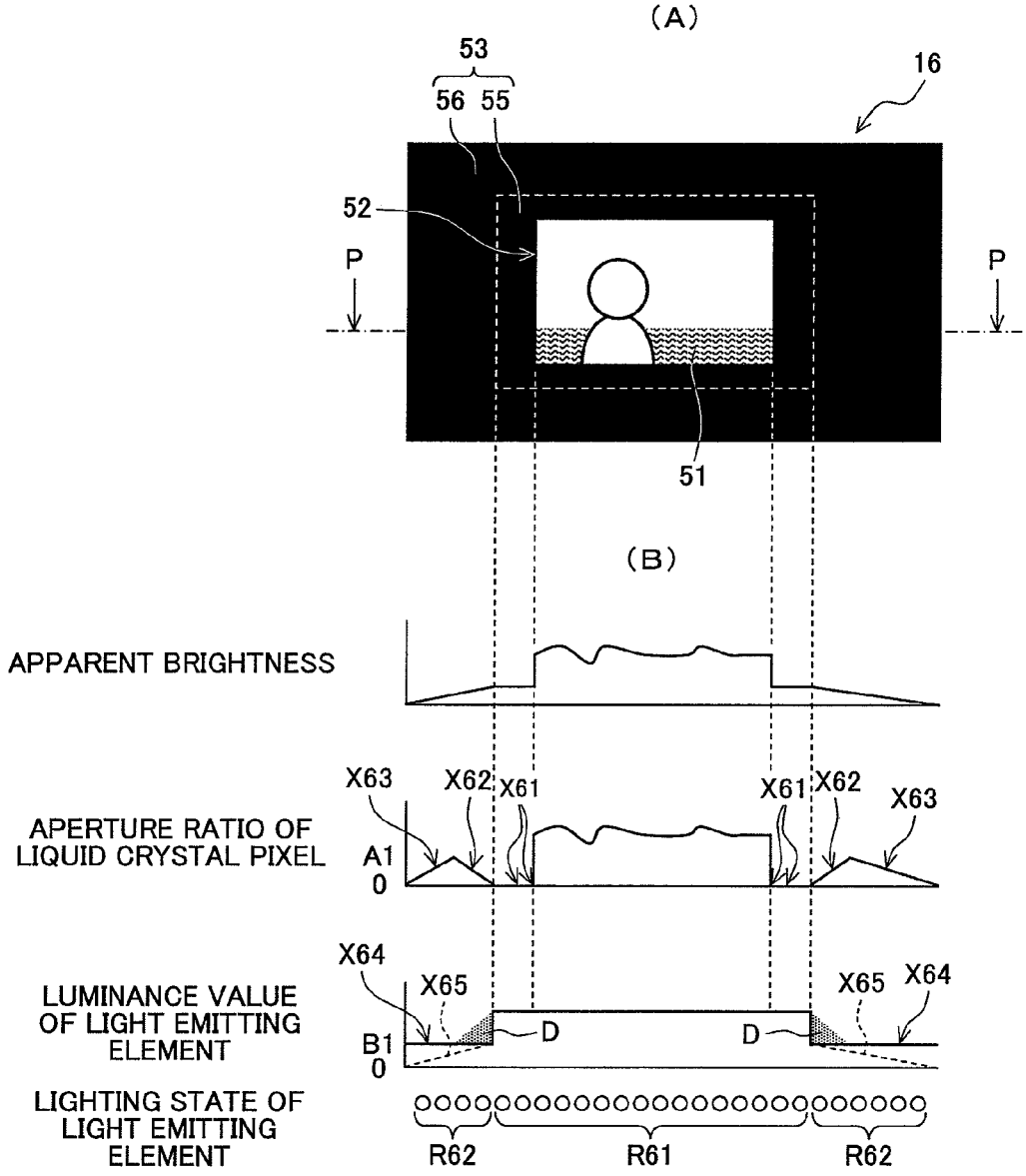
FIG. 8 is a further diagram explaining the display state of the liquid crystal panel, the aperture ratio of the liquid crystal pixels, and the luminance value of the light emitting elements.

FIG. 8(A) depicts a state where the gradation image appears to be displayed in the region 53 outside the video display area, and FIG. 8(B) depicts, similar to the graphs of FIG. 2(B), a graph of the apparent brightness, a graph of the aperture ratio of the liquid crystal pixels, a graph of the luminance value of the light emitting elements, and the lighting state of the light emitting elements.

The video display control portion 12' controls the aperture ratio of the liquid crystal pixels lying on the area edge 52 of the video display area 51 and the aperture ratio of the liquid crystal pixels in the illuminated region 55 of the region 53 outside the video display area to be the first predetermined aperture ratio (e.g., 0), as designated by reference alphanumeral X61 of FIG. 8(B). Furthermore, the video display control portion 12' gradually increases the aperture ratio of the liquid crystal pixels of the light leakage corresponding region in the region 56 outside the illuminated region until reaching the second predetermined aperture ratio (e.g., A1) according as apart from the video display area 51, as designated by reference alphanumeral X62 of the diagram, opposite to the variation (see dots D) in the luminance value of the light leakage. Then, the video display control portion 12' controls the aperture ratio of the liquid crystal pixels of regions other than the light leakage corresponding region in the region 56 outside the illuminated region to gradually decrease from the second predetermined aperture ratio according as apart from the video display area 51, as designated by reference alphanumeral X63 of the diagram.

The backlight control portion 14' controls the luminance value of light emitting elements R62 illuminating the region 56 outside the illuminated region of the region 53 outside the video display area to be the third predetermined luminance value (e.g., B1) less than or equal to the luminance value of light emitting elements R61 illuminating the video display area 51 and the illuminated region 55, as designated by reference alphanumeral X64 of FIG. 8(B).

Otherwise, the backlight control portion 14' may control the luminance value of each of the light emitting elements illuminating the region 56 outside the illuminated region of the region 53 outside the video display area to gradually decrease according as apart from the light emitting elements R61 illuminating the video display area 51, as designated by reference alphanumeral X65 of FIG. 8(B).

In this manner, the light leakage can be rendered inconspicuous by allowing a gradation image to appear to be displayed in the region 53 outside the video display area.

Example 3

Otherwise, the light leakage may be rendered inconspicuous by setting the illumination area of the backlight unit 17 illuminating the video display area 51 of the liquid crystal panel 16 to be smaller than the video display area 51.

Figure 9:
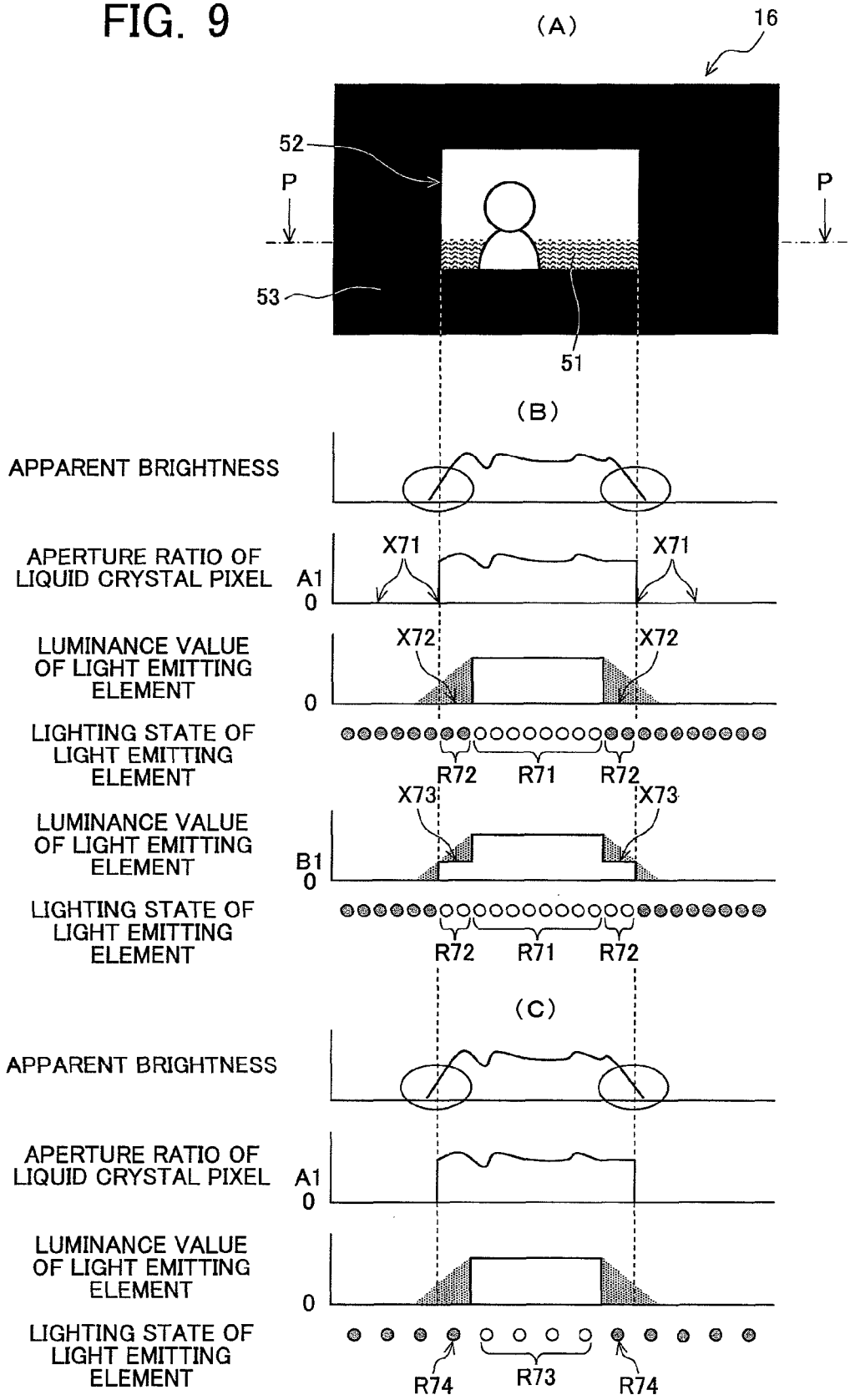
FIG. 9 is still another diagram explaining the display state of the liquid crystal panel, the aperture ratio of the liquid crystal pixels, and the luminance value of the light emitting elements.

FIG. 9(A) depicts the liquid crystal panel 16 currently displaying a video displayed thereon when the illumination area is set to be smaller than the video display area 51. FIGS. 9(B) and 9(C) depict, similar to the graphs of FIG. 2(B), a graph of the apparent brightness, a graph of the aperture ratio of the liquid crystal pixels, a graph of the luminance value of the light emitting elements, and the lighting state of the light emitting elements.

The video display control portion 12 (or the video display control portion 12') controls the aperture ratio of the liquid crystal pixels lying on the area edge 52 of the video display area 51 and the aperture ratio of the liquid crystal pixels lying in the region 53 outside the video display area to be the first predetermined aperture ratio (e.g., 0), as designated by reference alphanumeral X71 of FIG. 9(B).

The backlight control portion 14 (or the backlight control portion 14') causes light emitting elements R71 corresponding to an inner region of the video display area 51 to emit light to illuminate a video displayed in the video display area 51 as designated by reference alphanumeral X72 of the diagram.

The backlight control portion 14 (or the backlight control portion 14') controls the luminance value of light emitting elements R72 corresponding to regions other than the inner region of the video display area 51 to be the fourth predetermined luminance value (e.g., 0).

The backlight control portion 14 (or the backlight control portion 14') may control the luminance value of the light emitting elements R72 to be the third predetermined luminance value (e.g., B1), as designated by reference alphanumeral X73 of the diagram.

Otherwise, the size of the video display area 51 may be controlled such that the area edge 52 of the video display area 51 is positioned between the light emitting elements.

The above control is effective in the case of, especially, less number of light emitting elements with wider intervals between the light emitting elements, as indicated by the lighting state of the light emitting elements of FIG. 9(C).

The video display control portion 12 alters the size of the video display area 51 as depicted in FIG. 9(C) such that the area edge 52 of the video display area 51 is positioned between the light emitting elements R73 illuminating the video display area 51 and the light emitting element R74 outside the light emitting elements R73.

As a result of this, as indicated in the graphs of FIGS. 9(B) and 9(C), the light leakage becomes inconspicuous although the vicinity of the area edge 52 of the video display area 51 slightly darkens (see encircled parts).

(Others)

The aperture ratio A1 of the liquid crystal pixels and the value of the backlight luminance value B1 are adjustable, and hence, for the purpose of energy saving, the backlight luminance value B1 may be reduced with the increased aperture ratio A1 of the liquid crystal pixels.

Available as the light emitting element is for example a white color LED optical for the liquid crystal panel illumination.

The aperture ratio of the liquid crystal pixels of each area and region may be controlled such that a decorative image is displayed in the region 53 outside the video display area or in the bordering image display region 54. Specifically, background image data to be displayed in the area 53 outside the video display area (or the bordering image display region 54) may be stored in the memory 19 (storage portion) so that the video display control portion 12 can display the background image data of the memory 19 in the region 53 outside the video display area.

Figure 4:
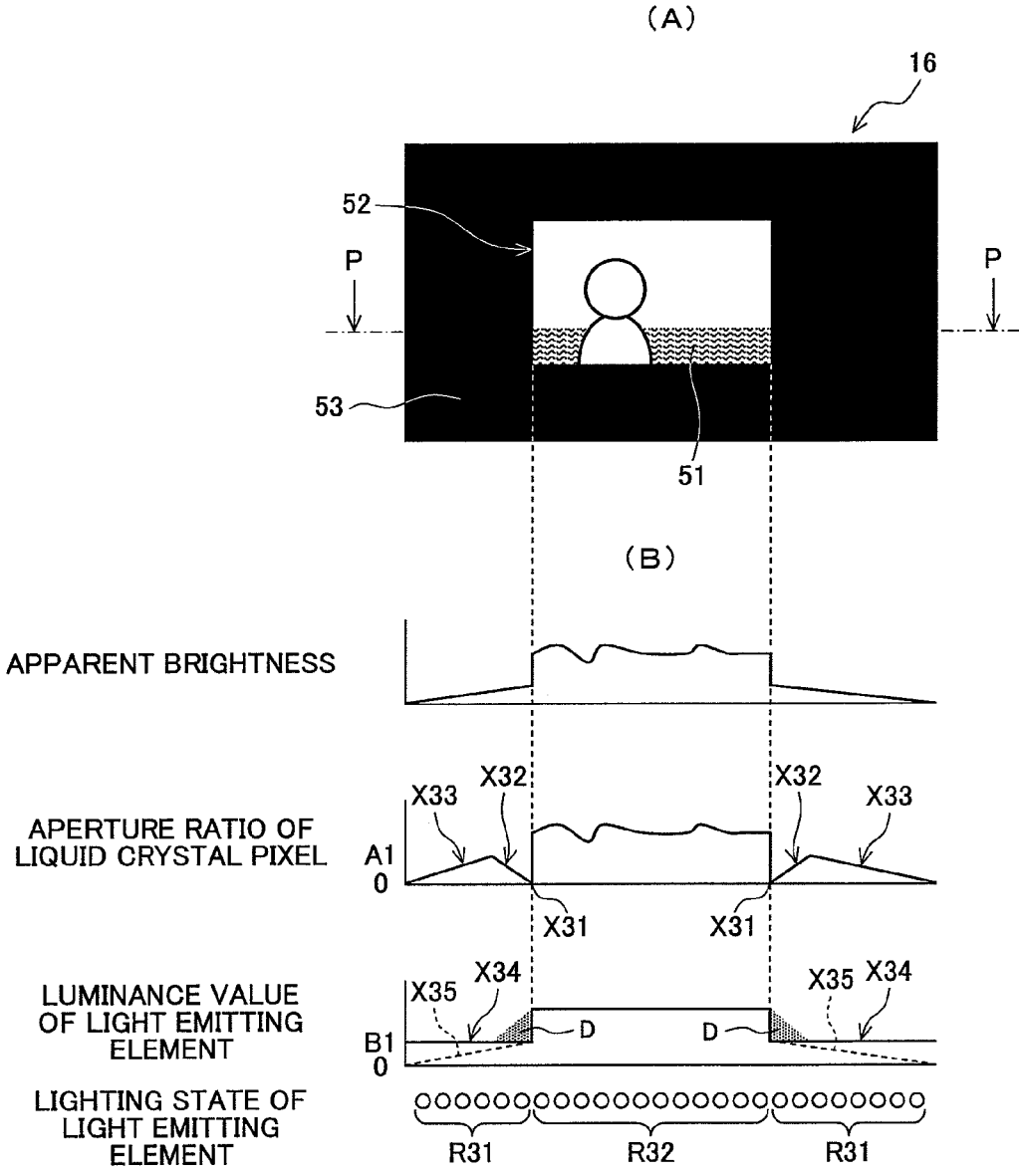
FIG. 4 is a further diagram explaining the display state of the liquid crystal panel, the aperture ratio of the liquid crystal pixels, and the luminance value of the light emitting elements.

The bordering image may be displayed (see FIG. 3) together with the display of the gray color image (see FIG. 2) or the display of the gradation image (see FIG. 4).

EXPLANATION OF REFERENCE NUMERALS

1,1' . . . liquid crystal display device, 11 . . . video processing portion, 12,12' . . . video display control portion, 13 . . . liquid crystal driving portion, 14,14' . . . backlight control portion, 15 . . . backlight driving portion, 16 . . . liquid crystal panel, 17 . . . backlight unit, 18 . . . control portion, 19 . . . memory, 51 . . . video display area, 52 . . . area edge, 53 . . . region outside video display area, 54 . . . bordering image display region, 55 . . . illuminated region, 56 . . . region outside illuminated region, 100 . . . liquid crystal panel, 101 . . . video display area, 102 . . . region outside video display area, 103 . . . peripheral region, 104 . . . region, 110,120 . . . backlight unit, 111,121 . . . illumination area

The invention claimed is:

1. A liquid crystal display device comprising a liquid crystal panel displaying video data, a backlight unit having a plurality of light emitting elements arranged thereon for illuminating the liquid crystal panel, a video display control portion displaying a video as a sub-screen in a restricted video display area of the liquid crystal panel, and a backlight control portion controlling a light emission luminance of the light emitting elements of the backlight unit in response to control of the video display control portion, wherein the video display control portion controls an aperture ratio of a liquid crystal pixel lying in a region outside a sub-screen video display area to be a predetermined value, the backlight control portion controls a luminance value of light emitting element illuminating the region outside the sub-screen video display area to be a predetermined value in response to the control of the video display control portion, and a luminance of the region outside the sub-screen video display area is controlled to be a predetermined value, based on a correlation between the aperture ratio of the liquid crystal pixel lying in the region outside the sub-screen video display area, controlled by the video display control portion, and the luminance value of the light emitting element illuminating the region outside the sub-screen video display area, controlled by the backlight control portion.

2. The liquid crystal display device as defined in claim 1, wherein the control of the luminance of the region outside the sub-screen video display area is carried out only by the control of the aperture ratio of the liquid crystal pixel lying in the region outside the sub-screen video display area by the video display control portion or only by the control of the luminance value of the light emitting elements illuminating the region outside the sub-screen video display area by the backlight control portion.

3. The liquid crystal display device as defined in claim 1 or 2, wherein the control of the aperture ratio of the liquid crystal pixel lying in the region outside the sub-screen video display area by the video display control portion is provided in accordance with the luminance value of the light emitting element illuminating the region outside the sub-screen video display area and/or with the luminance value of a light leakage of light emission from the light emitting element for illuminating a display video in the video display area.

4. The liquid crystal display device as defined in claim 3, wherein control of the aperture ratio of liquid crystal pixel lying on a site corresponding to a region illuminated by the light leakage is provided so as to gradually increase according as going away from the video display area for at least a certain stretch, opposite to a variation in the luminance value of the light leakage that gradually decreases according as going away from the video display area.

5. The liquid crystal display device as defined in claim 1 or 2, wherein the control of the aperture ratio of the liquid crystal pixel by the video display control portion and/or the control of the luminance value of the light emitting element by the backlight control portion is executed in such a manner that the luminance value of the region outside the sub-screen video display area of the liquid crystal panel is constant or gradually decreases according as going away from the video display area for at least a certain stretch.

6. The liquid crystal display device as defined in claim 1 or 2, wherein the control of the aperture ratio of the liquid crystal pixel by the video display control portion and/or the control of the luminance value of the light emitting element by the backlight control portion is effected in such a manner as to border a peripheral region around the video display area of the liquid crystal panel.

7. The liquid crystal display device as defined in claim 1 or 2, wherein in order to illuminate a display video lying in the video display area, the backlight control portion causes light emitting element corresponding to the video display area to emit light or causes the light emitting element corresponding to the video display area and light emitting element corresponding to a proximate region outside the video display area to emit light.

8. The liquid crystal display device as defined in claim 1 or 2, wherein in order to illuminate a display video lying in the video display area, the backlight control portion causes light emitting element corresponding to an inner region inside the video display area to emit light.

9. The liquid crystal display device as defined in claim 1 or 2, comprising a memory portion storing background image data to be displayed in the region outside the sub-screen video display area, wherein the video display control portion displays the background image data of the memory portion in the region outside the sub-screen video display area.

* * * * *